US008037691B2

(12) United States Patent
Commaret et al.

(10) Patent No.: US 8,037,691 B2
(45) Date of Patent: Oct. 18, 2011

(54) DEFLECTOR FOR A COMBUSTION CHAMBER ENDWALL, COMBUSTION CHAMBER EQUIPPED THEREWITH AND TURBINE ENGINE COMPRISING THEM

(75) Inventors: Patrice Andre Commaret, Rubelles (FR); Didier Hippolyte Hernandez, Quiers (FR); David Locatelli, Gex (FR)

(73) Assignee: SNECMA, Paris (FR)

( * ) Notice: Subject to any disclaimer, the term of this patent is extended or adjusted under 35 U.S.C. 154(b) by 921 days.

(21) Appl. No.: 11/950,880

(22) Filed: Dec. 5, 2007

(65) Prior Publication Data

US 2008/0141674 A1 Jun. 19, 2008

(30) Foreign Application Priority Data

Dec. 19, 2006 (FR) ..... 06 55657

(51) Int. Cl.
*F02C 1/00* (2006.01)
*F02G 3/00* (2006.01)

(52) U.S. Cl. ..... 60/756; 60/804; 60/737; 60/740

(58) Field of Classification Search ..... 60/752–760, 60/796–800, 804, 737, 740, 742, 746, 747, 60/748, 734, 733
See application file for complete search history.

(56) References Cited

U.S. PATENT DOCUMENTS 4,567,730 A * 2/1986 Scott ..... 60/757
4,843,825 A * 7/1989 Clark ..... 60/756
5,154,060 A * 10/1992 Walker et al. ..... 60/746
5,329,761 A * 7/1994 Ablett et al. ..... 60/804
5,682,747 A * 11/1997 Brown et al. ..... 60/746
5,956,955 A * 9/1999 Schmid ..... 60/748
6,557,349 B1 * 5/2003 Young et al. ..... 60/752
6,952,927 B2 * 10/2005 Howell et al. ..... 60/798
6,973,419 B1 12/2005 Fortin et al.
7,478,534 B2 * 1/2009 Guezengar et al. ..... 60/796
7,665,306 B2 * 2/2010 Bronson et al. ..... 60/752
7,673,460 B2 * 3/2010 Hernandez et al. ..... 60/796
7,730,725 B2 * 6/2010 Faulder et al. ..... 60/752

(Continued)

FOREIGN PATENT DOCUMENTS

EP 0 153 842 A1 9/1985

(Continued)

OTHER PUBLICATIONS

U.S. Appl. No. 12/190,105, filed Aug. 12, 2008, Commaret et al.

*Primary Examiner* — William Rodriguez
(74) *Attorney, Agent, or Firm* — Oblon, Spivak, McClelland, Maier & Neustadt, L.L.P.

(57) ABSTRACT

A deflector takes the form of a plate provided with a hole. The plate is a portion of a conical surface of revolution about a cone axis with a concave face and a convex face. The plate includes a contour with four sides. Two of these the sides are concentric circular arcs centered on the cone axis. The other two sides are segments of generatrices of the cone which connect the first sides. The invention is applicable to a deflector of a chamber endwall of a combustion chamber of a turbine engine.

14 Claims, 5 Drawing Sheets

U.S. PATENT DOCUMENTS

| | | | | |
|---|---|---|---|---|
| 7,757,495 | B2 * | 7/2010 | Bessagnet et al. | 60/800 |
| 7,770,397 | B2 * | 8/2010 | Patel et al. | 60/752 |
| 7,770,398 | B2 * | 8/2010 | De Sousa et al. | 60/752 |
| 7,775,051 | B2 * | 8/2010 | Hernandez et al. | 60/796 |
| 2005/0081528 | A1 * | 4/2005 | Howell et al. | 60/748 |
| 2005/0178126 | A1 * | 8/2005 | Young et al. | 60/747 |
| 2007/0180834 | A1 * | 8/2007 | Caboche et al. | 60/804 |
| 2007/0256418 | A1 * | 11/2007 | Mueller et al. | 60/752 |
| 2008/0115506 | A1 * | 5/2008 | Patel et al. | 60/804 |
| 2009/0013694 | A1 * | 1/2009 | Hernandez et al. | 60/752 |

FOREIGN PATENT DOCUMENTS

| | | | |
|---|---|---|---|
| EP | 1 482 247 | A1 | 12/2004 |
| EP | 1 584 871 | A2 | 10/2005 |

* cited by examiner

DEFLECTOR FOR A COMBUSTION CHAMBER ENDWALL, COMBUSTION CHAMBER EQUIPPED THEREWITH AND TURBINE ENGINE COMPRISING THEM

BACKGROUND OF THE INVENTION AND DESCRIPTION OF THE PRIOR ART

The present invention relates to the technical field of combustion chambers for turbine engines. It is aimed in particular at a thermal protection shield, or deflector, for a combustion chamber endwall. It is also aimed at a combustion chamber provided with at least one such deflector. It is finally aimed at a turbine engine equipped with such a combustion chamber and/or with at least one such deflector.

Throughout the following, the terms "axial", "radial" and "transverse" correspond to an axial direction, a radial direction and a transverse plane of the turbine engine respectively, and the terms "upstream" and "downstream" correspond to the gas flow direction in the turbine engine respectively.

A conventional "divergent" combustion chamber is illustrated in FIG. 11, which is an axial section showing one half of the combustion chamber, the other half thereof being derived by symmetry with respect to the axis (not shown) of the turbine engine. The combustion chamber 110 is contained within a diffusion chamber 130 which is an annual space defined between an external casing 132 and an internal casing 134, into which space is introduced a compressed oxidant originating upstream from a compressor (not shown) by way of an annular diffusion duct 136.

This conventional "divergent" combustion chamber 110 comprises an external wall 112 and an internal wall 114 which are coaxial and substantially conical and which widen out from upstream to downstream with a cone angle $\alpha$. The external 112 and internal 114 walls of the combustion chamber 110 are connected to one another toward the upstream end of the combustion chamber by a chamber endwall 116.

The chamber endwall 116 is a substantially frustoconical component which extends between two substantially transverse planes while widening out from downstream to upstream. The chamber endwall 116 is connected to each of the two external 112 and internal 114 walls of the combustion chamber 110. Owing to the small inclination of the combustion chamber 110, the chamber endwall 116 has a small conical taper. It is provided with injection systems 118 through which there pass injectors 120 which introduce fuel at the upstream end of the combustion chamber 110 where the combustion reactions take place.

These combustion reactions have the effect of radiating heat from downstream to upstream in the direction of the chamber endwall 116. To prevent this chamber endwall 116 from being damaged due to the heat, thermal protection shields, also termed deflectors 122, are provided. These deflectors 122 are substantially flat plates which are arranged on and fastened by brazing to an inner face of the chamber endwall 116. They are cooled by means of cooling air jets which enter the combustion chamber 110 through cooling orifices 124 drilled in the chamber endwall 116. These air jets, which flow from upstream to downstream, are guided by chamber fairings 126, cross the chamber end wall 116 through the cooling orifices 124, and impact on an upstream face of the deflectors 122.

In more recent designs of "convergent" combustion chambers, the external and internal walls of the combustion chamber are inclined by widening out from downstream to upstream, and not from upstream to downstream as in the case of the conventional "divergent" combustion chambers described above. These "convergent" combustion chambers can have a larger cone angle $\alpha$ than the cone angle $\alpha$ of the "divergent" combustion chambers.

Such a large inclination of the combustion chamber has repercussions on the conical taper of the chamber endwall and on the position of the deflectors with respect to the chamber endwall. Such a combustion chamber is partially illustrated in FIG. 12, in axial section. This figure shows an axial direction 100 parallel to the axis of the turbine engine, the main direction 200 of the combustion chamber 110, and the angle $\alpha$ between these two axes 100, 200. Owing to the large inclination of the combustion chamber 110, the chamber endwall 116 has a larger conical taper than a traditional combustion chamber endwall. When not only the inclination of the chamber endwall 116 is large but also the injectors 120 are present in a small number and/or the combustion chamber 110 has a small diameter, that affects the distance D between the chamber endwall and the planar deflectors. In the plane of the axial section shown in FIG. 12, the distance D between the chamber endwall 116 and the deflectors 122 appears to be constant. However, as illustrated in FIG. 13, which is a section on the plane XIII-XIII in FIG. 12, this distance D diminishes as it extends over a circumferential generatrix of the chamber endwall 116, to a point such that the chamber endwall 116 and the deflectors 122 can come into contact. Such a contact between these components is detrimental to a correct assembly of the deflectors in the combustion chamber. The fact that the distance D between the chamber endwall 116 and the deflector 122 is not constant is detrimental to good cooling of said deflector 122.

SUMMARY OF THE INVENTION

The object of the invention is to overcome these disadvantages, and the invention provides a thermal protection shield, or deflector, for a chamber endwall that is configured such that the distance D between the chamber endwall and this deflector remains constant.

According to a first aspect, the invention relates to a deflector for a chamber endwall of a combustion chamber of a turbine engine, taking the form of a plate provided with a hole.

According to a first embodiment, said plate is a portion of a conical surface of revolution about a cone axis, said plate having a substantially concave face and a substantially convex face, and said plate having a contour which possesses four sides, of which two first sides are concentric circular arcs centered on said cone axis, and two second sides are segments of generatrices of said cone which connect said first sides.

According to a second embodiment, said deflector comprises all the features of the first embodiment and additionally comprises a central region which surrounds said hole and a peripheral region which surrounds said central region, said central region having a planar face on the same side as said concave face.

According to a first variant of the second embodiment, said central region is substantially circular. According to this first variant of the second embodiment, said deflector has a connection region between said peripheral region and said central region.

According to a second variant of the second embodiment, said central region is a plane portion bounded by two edges which are segments of generatrices of said cone which are parallel to said second sides.

In a manner common to the first embodiment and to the two variants of the second embodiment, said first sides of the plate forming the deflector are each provided with a lip extending on the same side as the concave face of the deflector.

In a manner common to the first embodiment and to the two variants of the second embodiment, said deflector is additionally provided with angular positioning means. According to one form of embodiment, said angular positioning means comprise a locking keyway intended to receive a locking key. According to this same form of embodiment, they also comprise a locking key intended to cooperate with a locking keyway formed in said deflector.

According to a second aspect, the invention relates to a combustion chamber which possesses at least one deflector according to the first aspect.

Preferably, said deflector is fastened by brazing to the chamber endwall.

Said combustion chamber additionally comprises angular positioning means. Said angular positioning means comprise a first locking keyway intended to receive a locking key. They additionally comprise a second locking keyway intended to cooperate with a stop finger.

Preferably, said combustion chamber is a "convergent" combustion chamber having an external wall and an internal wall which are coaxial and substantially frustoconical and are inclined by widening out from downstream to upstream.

According to a third aspect, the invention relates to a turbine engine which comprises a combustion chamber according to the first aspect and/or at least one deflector according to the second aspect.

BRIEF DESCRIPTION OF THE DRAWINGS

The invention will be better understood on reading the detailed description below of one particular embodiment of the invention given by way of nonlimiting indication and illustrated by means of the appended drawings, in which.

DESCRIPTION OF THE PREFERRED EMBODIMENTS

Figure 1:
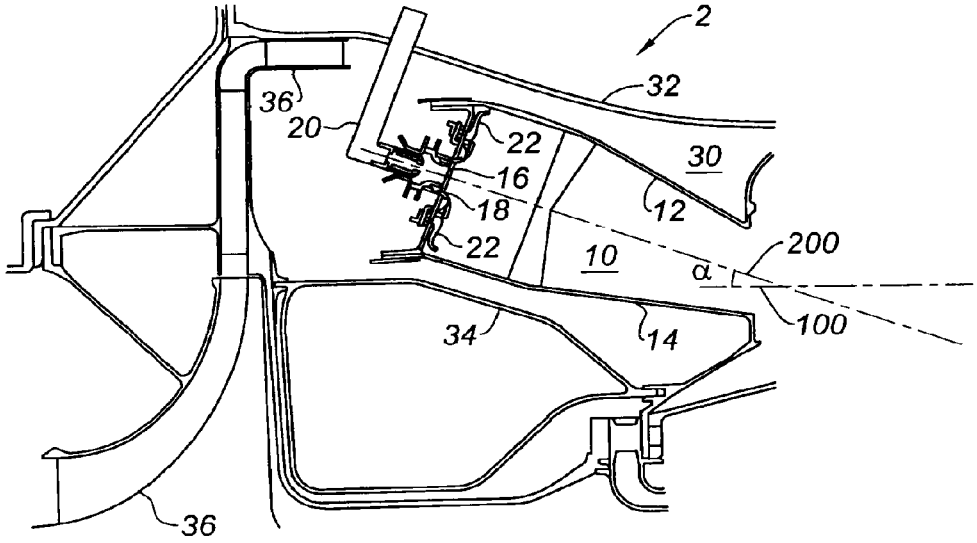
FIG. 1 is a view in axial section of part of a turbine engine, including the "convergent" combustion chamber, showing one half of the combustion chamber, the other half being derived by axial symmetry.
Figure 11:
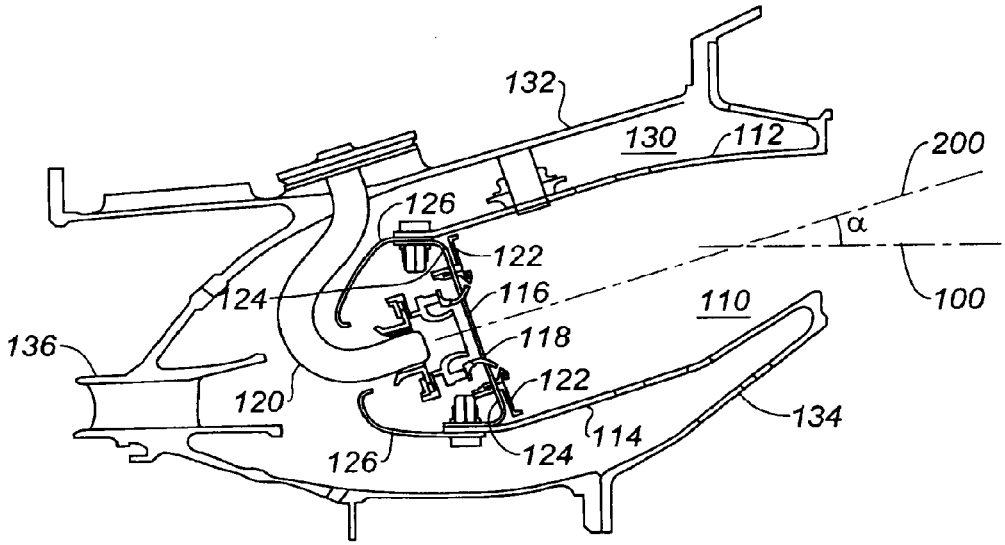
Fig. 11 BACKGROUND ART
FIG. 11, already described, is a view in axial section of a "divergent" combustion chamber of the prior art.

With reference first of all to FIG. 1, there is represented a portion of a turbine engine 2 which extends in an axial direction 100 and is equipped with a combustion chamber 10. This "convergent" combustion chamber 10 comprises an external wall 12 and an internal wall 14 which are coaxial and substantially frustoconical.

The combustion chamber 10 is contained within a diffusion chamber 30 which is an annular space defined between an external casing 32 and an internal casing 34, into which space is introduced a compressed oxidant originating upstream from a compressor (not shown) by way of an annular diffusion duct 36.

The external 12 and internal 14 walls of the combustion chamber 10 are connected to one another toward the upstream end of the combustion chamber by a chamber endwall 16, which is a substantially frustoconical component extending between two substantially transverse planes while widening out from upstream to downstream. The chamber endwall 16 is connected to each of the two external 12 and internal 14 walls of the combustion chamber 10. It is provided with injection systems 18 through which there pass injectors 20 which traverse the outer casing 32 and which introduce fuel at the upstream end of the combustion chamber 10 where the combustion reactions take place.

Figure 2:
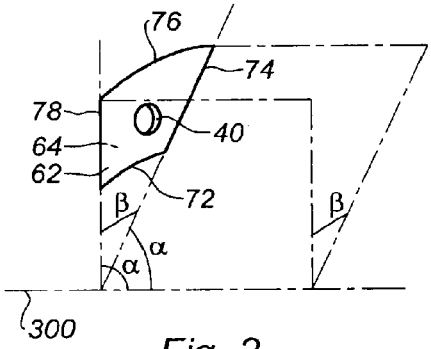
FIG. 2 represents a deflector according to the invention in perspective and schematically.

A first embodiment of a deflector 22 according to the invention is represented schematically and in perspective in FIG. 2. This deflector 22 takes the form of a plate which is a portion of a conical surface of a cone, this cone having a cone axis 300 and a cone angle $\alpha$. In service, when said deflector 22 is installed on the chamber endwall 16, said cone axis 300 is substantially coincident with the axis 100 of the turbine engine. The deflector 22 possesses a concave face 62 and a convex face 64, and also a contour having four sides 72, 74, 76, 78. Two 72, 76 of these four sides are concentric parallel circular arcs having the same axis 300. The other two 74, 78 of these four sides are segments of generatrices of the cone which connect the two circular arc-shaped sides 72, 76. The deflector 22 according to the first embodiment comprises a substantially central injection hole 40 intended to be situated opposite an injection system 18 of the chamber endwall 16 when the deflector 22 is installed on the chamber endwall 16. Said injection hole 40 is a hole with a raised edge, that is to say that it comprises an edge 402 which rises on the same side as the upstream face of the deflector 22.

Figure 3:
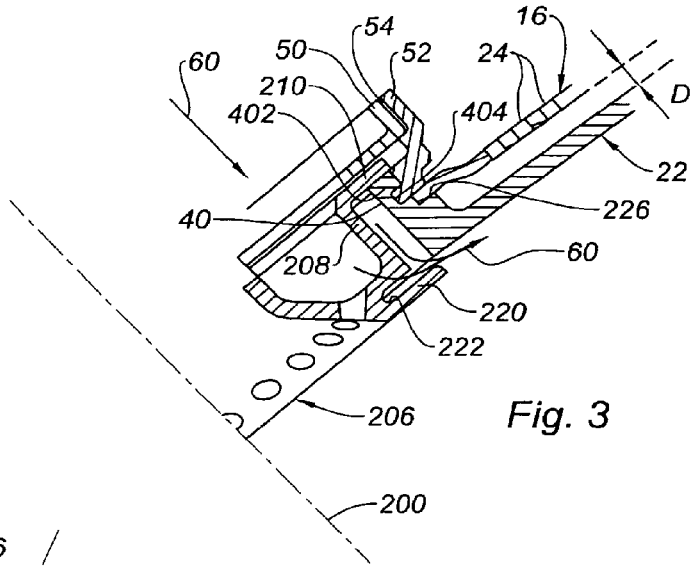
FIG. 3 represents part of a "convergent" combustion chamber, and a deflector according to a first embodiment of the invention, viewed in axial section.

This first embodiment of the deflector 22 according to the invention is illustrated in FIG. 3, which illustrates part of the chamber endwall 16 in the region of an injection system 18 in which there is arranged an injection bowl 206. The chamber endwall 16 has a large conical taper (see FIG. 1). The deflector 22 is arranged parallel to the chamber endwall 16, toward the inside of the combustion chamber 10. Owing to the conical curvature of the deflector 22, which is analogous to the conical curvature of the chamber endwall 16, said deflector 22 is parallel to said chamber endwall 16.

One advantage of such a deflector 22 lies in the fact that the distance D between said deflector 22 and the chamber endwall 16 is substantially constant for the entire surface of said deflector 22. Therefore, such a deflector 22 can be cooled satisfactorily by streams of air which impact on it after having passed through cooling orifices 24 formed in the chamber endwall 16.

FIG. 3 also shows the relative position of the deflector 22 with respect to the injection bowl 206.

The injection bowl 206 is oriented about an axis 200. It comprises a flange 208 which itself comprises a mounting rim 210 which is retained axially between a first ring 50 and the edge 402 of the injection hole 40 in the deflector 22. Around its injection system 18, the chamber endwall 16 is immobilized between an outer shoulder 226 of the edge 402 in the injection hole 40 of the deflector 22 and a second ring 52 which is itself fastened by brazing in an outer peripheral groove 404 in the edge 402 of the injection hole 40 in the deflector 22. The second ring 52 also has an inner shoulder in which the first ring 50 is fitted, the two rings 50, 52 being fastened together by a weld bead 54.

This assembly is such that the flange 208 is allowed to move slightly in a plane perpendicular to the axis 200. Therefore, the injection bowl 206 is allowed a slight transverse play with respect to the axis 200, thereby allowing streams of air to enter through the injection hole 40 even when the injection bowl 206 is in place. These streams of air, depicted by the arrows 60 in the figures, have the function of cooling the edge 402 of the injection hole 40 in the deflector 22, this edge 402 constituting a relatively thick region of the deflector 22 that cannot be reached by the cooling air passing through the cooling orifices 24 in the chamber endwall 16.

The injection bowl 206 also comprises a collar 220 situated inside the combustion chamber 10, this collar being separated from the flange 208 by a channel 222 and extending parallel to the mounting rim 210 substantially until it is plumb with the inner face of the edge 402 of the injection hole 40 in the deflector 22.

Figure 4:
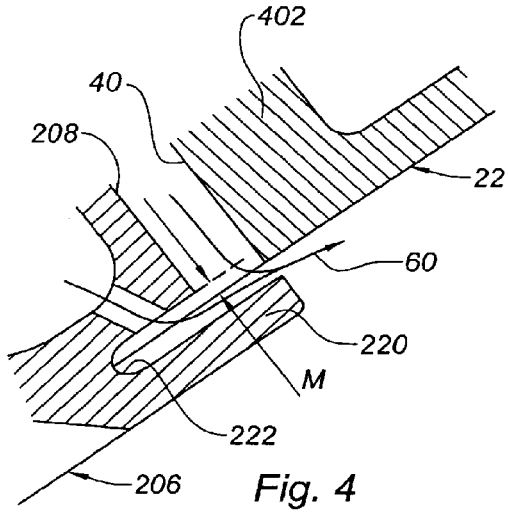
FIG. 4 is an enlarged view of a detail of FIG. 3.

FIG. 4 shows an enlarged detail of FIG. 3. More precisely, it shows the edge 402 of the injection hole 40 in the deflector 22 and also the flange 208, the collar 220 and the channel 222 in the injection bowl 206. Owing to the conical, and no longer planar, shape of the deflector 22, it appears that the inner face of the deflector 22 is offset with respect to the inner face of the flange 208. This offset, or step, is designated by the letter M in FIG. 4. The existence of this step M is capable of causing a disturbance in the flow of the cooling jets represented by the arrow 60, for example in the form of eddies, a situation which is liable to affect the cooling of the raised edge 402 of the injection hole 40 in the deflector 22.

FIGS. 7-8 and 9-10 respectively represent a first variant and a second variant of a second embodiment of the deflector 22, which constitutes an improvement of the first embodiment described above. The features of the first embodiment of the deflector 22 which has already been described are also features of the two variants of the second embodiment which are illustrated in these FIGS. 7-10.

The deflector 22 according to one or other variant of the second embodiment has a central region 90 which surrounds the injection hole 40, and a peripheral region 92 which surrounds the central region 90 as far as the edges 72, 74, 76, 78 of the deflector 22. The peripheral region 92 has a concave conical surface.

Figure 7:
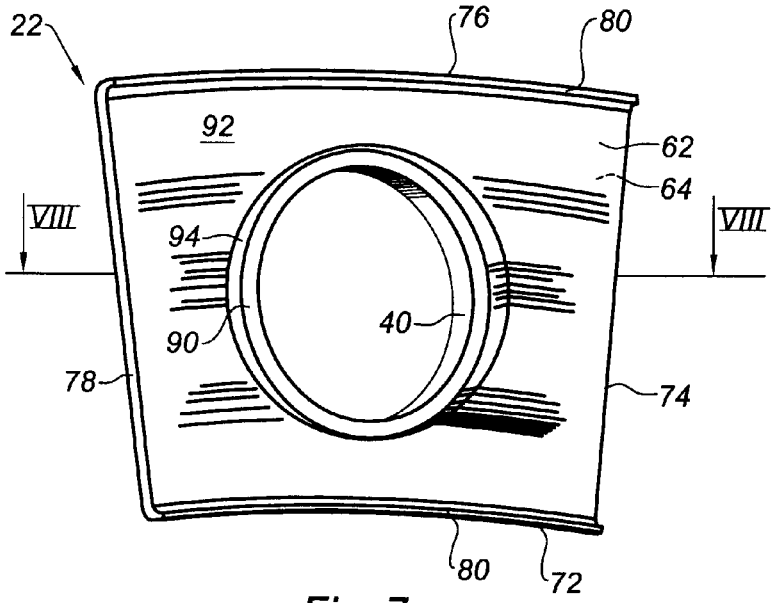
FIG. 7 is a perspective view of a first variant of the second embodiment.
Figure 8:
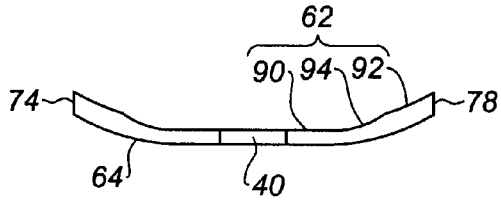
FIG. 8 is a view in section on the plane VIII-VIII in FIG. 7.

According to the first variant of the second embodiment illustrated in FIGS. 7 and 8, said central region 90 is circular and has a planar surface, whereas the peripheral region 92 has a concave conical surface. A connection region 94 connects said central region 90 and said peripheral region 92.

Figure 9:
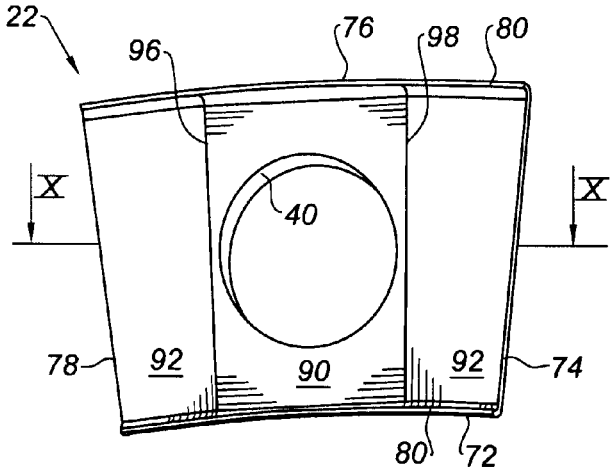
FIG. 9 is a perspective view of a second variant of the second embodiment.
Figure 10:
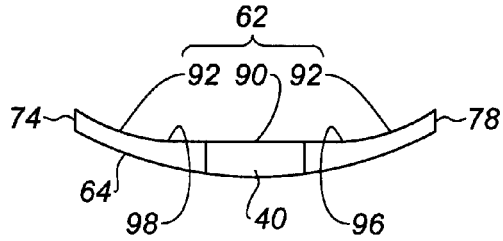
FIG. 10 is a view in section on the plane X-X in FIG. 9.
Figure 12:
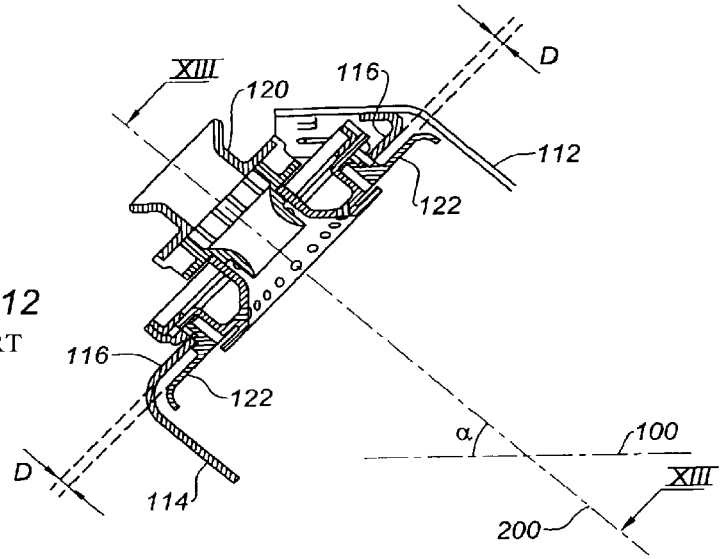
Fig. 12 BACKGROUND ART
FIG. 12, already described, represents on a larger scale part of a "convergent" combustion chamber, and a planar deflector of the prior art, viewed in axial section.
Figure 13:
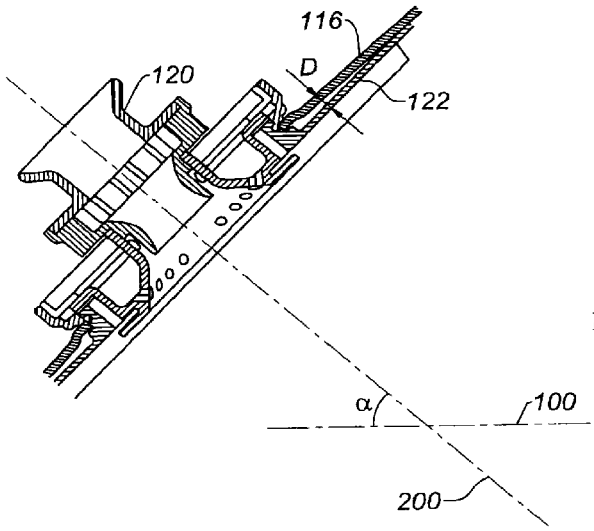
Fig. 13 BACKGROUND ART
FIG. 13, already described, represents on a larger scale part of a "convergent" combustion chamber, and a planar deflector of the prior art, viewed in section in the direction of the arrows XIII-XIII in FIG. 12.

According to the second variant of the second embodiment illustrated in FIGS. 9 and 10, said central region 90 is contained between two edges 96, 98 which are substantially parallel to the rectilinear sides 74, 78 of the contour of said deflector 22, and it extends as far as the circular arc-shaped sides 72, 76 of the contour of said deflector 22. It has a planar surface. In other words, the two edges 96, 98 form the intersection between the planar surface of said central region 90 and the concave conical surface of the peripheral region 92.

In a manner common to the first variant and to the second variant of the second embodiment, the central region 90 has a planar surface on the same side as the concavity of the deflector 22.

Figure 5:
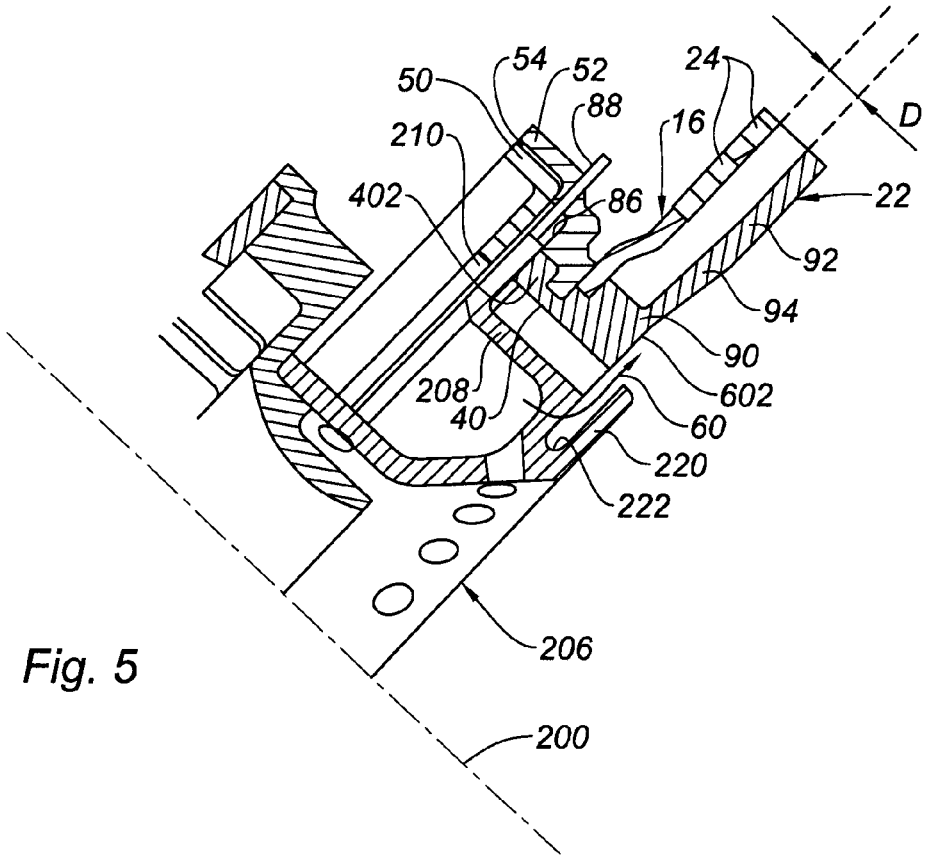
FIG. 5 is analogous to FIG. 3 for a second embodiment of the invention, viewed in axial section, and shows first angular positioning means.

As illustrated in FIG. 5, and in an analogous manner to the deflector of the first embodiment illustrated in FIGS. 3 and 4, the distance D between said deflector 22 and the chamber endwall 16 is substantially constant for the entire surface of said deflector 22. Therefore, the deflector 22 can be cooled satisfactorily by streams of air which impact on it after having passed through the cooling orifices 24 formed in the chamber endwall 16. Furthermore, owing to the planarity of the central region 90, the streams of cooling air 60 can flow from outside the bowl 206 through the injection opening 40 without being disturbed by turbulence. It follows that the cooling of the raised edge 402 of the injection hole 40 in the deflector 22 can take place satisfactorily. The reason for this is that, unlike the configuration of the first embodiment, the planar surface of the central region 90 and the inner face of the flange 208 of the bowl 206 are situated substantially in the same plane.

Furthermore, and as illustrated in FIGS. 7 and 9, the two circular arc-shaped sides 72, 76 of the plate forming the deflector 22 are each provided with a lip 80 extending on the same side as the concave face 62 of the deflector. This feature is common to the first embodiment and to the two variants of the second embodiment. The lips 80 of the deflector 22 have the function of creating a cooling film by guiding the air for cooling the deflectors 22 that has come from the cooling orifices 24, in order to cool the external 12 and internal 14 walls of the combustion chamber 10.

Furthermore, the deflector 22 is provided with angular positioning means consisting of first angular positioning means and of second angular positioning means. This feature is common to the first embodiment and to the two variants of the second embodiment.

Figure 6:
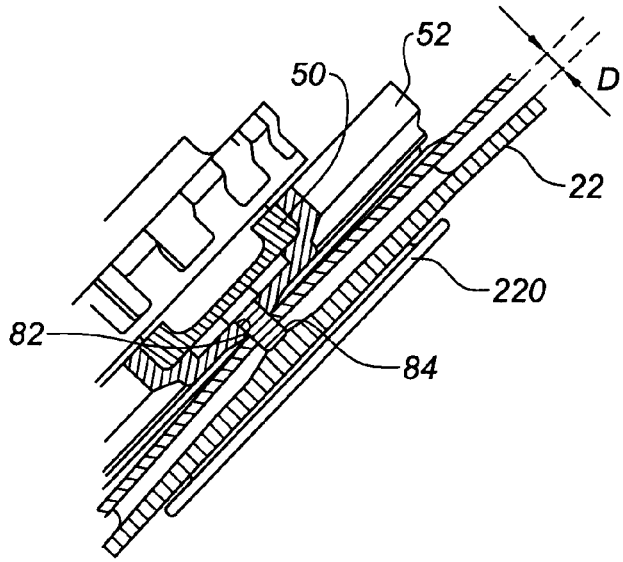
FIG. 6 represents, in axial section, other angular positioning means.

FIG. 6 illustrates the first angular positioning means 82, 84 which comprise a first locking keyway 82, comprising three sections formed respectively in the chamber endwall 16, the deflector 22 and the second ring 52, and a key 84. The insertion of the key 84 in said first locking keyway 82 prevents a relative rotation of the second ring 52 and the deflector 22 with respect to the chamber endwall 16.

FIG. 5 illustrates the second angular positioning means 86, 88 which comprise a second locking keyway 86 formed in the second ring 52 and a stop finger 88 secured to the injection bowl 206. The insertion of the stop finger 88 into said second locking keyway 86 prevents a relative rotation of the injection bowl 206 with respect to the second ring 52.

The cooperation between these four angular positioning means 82, 84, 86, 88 thus makes it possible to prevent a relative rotation of the deflector 22 with respect to the chamber endwall 16. Therefore, the deflector 22 and the chamber endwall 16 remain correctly positioned with respect to one another, their parallelism is maintained, and the distance D remains constant.

The invention also relates to a combustion chamber 10 which comprises a chamber endwall 16 and at least one deflector 22 as described above. Preferably, said deflector 22 is fastened by brazing to said chamber endwall 16.

The invention claimed is:

1. A deflector for a chamber endwall of a combustion chamber of a turbine engine, comprising:

a plate provided with a hole, wherein said plate is a portion of a conical surface of revolution about a cone axis, said plate including a substantially concave face and a substantially convex face, said plate includes a contour which possesses four sides, of which two first sides are concentric circular arcs centered on said cone axis, and two second sides are segments of generatrices of said cone which connect said first sides, and said deflector further comprises a central region which surrounds said hole and a peripheral region which surrounds said central region, said central region including a planar face on the same side as said substantially concave face and being a plane portion bounded by two edges which are segments of generatrices of said cone which are substantially parallel to said second sides.

2. The deflector as claimed in claim 1, wherein said central region is substantially circular.

3. The deflector as claimed in claim 2, which has a connection region between said peripheral region and said central region.

4. The deflector as claimed in claim 1, wherein said first sides of the plate forming the deflector are each provided with a lip extending on the same side as the concave face of the deflector.

5. A combustion chamber comprising at least one deflector as claimed in claim 1.

6. The combustion chamber as claimed in claim 5, wherein said deflector is fastened by brazing to the chamber endwall.

7. The combustion chamber as claimed in claim 5, further comprising an angular positioning device.

8. The combustion chamber as claimed in claim 7, wherein said angular positioning device includes a first locking keyway which receives a locking key.

9. The combustion chamber as claimed in claim 7, wherein said angular positioning device includes a second locking keyway which cooperates with a stop finger.

10. The combustion chamber as claimed in claim 5, wherein said combustion chamber is a "convergent" combustion chamber which includes an external wall and an internal wall which are coaxial and substantially frustoconical and are inclined by widening out from downstream to upstream.

11. A turbine engine which comprises a combustion chamber as claimed in claim 5.

12. A combustion chamber of a turbine engine, comprising:

an internal wall;

an external wall;

a chamber endwall connecting the internal wall and the external wall at an upstream end of the combustion chamber;

a deflector installed on the chamber endwall, the deflector including a plate provided with a substantially central injection hole with a raised edge provided on the same side as an upstream face of the deflector; and an injection system provided at the chamber endwall, the injection system including an injection bowl including a flange with a mounting rim, and a collar disposed inside the combustion chamber, separated prom the flange by a channel and extending substantially parallel to the mounting rim, wherein the plate is a portion of a conical surface of revolution about a cone axis and includes a substantially concave face, a substantially convex face, and a contour with first and second sides which are concentric circular arcs centered on the cone axis and third and fourth sides which are segments of generatrices of the cone connecting the first and second sides, wherein the mounting rim is axially retained between a first ring and the edge of the injection hole, wherein the chamber endwall is immobilized between an outer shoulder of the edge of the injection hole and a second ring which is brazed in an outer peripheral groove in the edge of the injection hole, and wherein the second ring includes an inner shoulder in which the first ring is fitted and the first ring and the second ring are welded.

13. The combustion chamber as claimed in claim 12, wherein the deflector further comprises a central region which surrounds said central injection hole with a planar face on the same side as said substantially concave face, and a peripheral region which surrounds said central region.

14. The combustion chamber as claimed in claim 13, wherein the central region is a plane portion bounded by two edges which are segments of generatrices of said cone which are substantially parallel to said third and fourth sides.

* * * * *

UNITED STATES PATENT AND TRADEMARK OFFICE

CERTIFICATE OF CORRECTION

PATENT NO. : 8,037,691 B2
APPLICATION NO. : 11/950880
DATED : October 18, 2011
INVENTOR(S) : Patrice Andre Commaret et al.

It is certified that error appears in the above-identified patent and that said Letters Patent is hereby corrected as shown below:

On the Title Page

Item (57) ABSTRACT, line 4, delete “these” after “Two of” and

Column 8, line 17, change “prom” to --from--.

Signed and Sealed this
Tenth Day of January, 2012

David J. Kappos

David J. Kappos
*Director of the United States Patent and Trademark Office*